United States Patent [19]

Thiel et al.

[11] Patent Number: 4,911,365

[45] Date of Patent: Mar. 27, 1990

[54] SPRAY GUN HAVING A FANNING AIR TURBINE MECHANISM

[75] Inventors: Leonard V. Thiel, New Baltimore, Mich.; James E. Hynds, 7147 Creeks Crossing, West Bloomfield, Mich. 48033

[73] Assignee: James E. Hynds, West Bloomfield, Mich.

[21] Appl. No.: 301,481

[22] Filed: Jan. 26, 1989

[51] Int. Cl.[4] ..... B05B 1/28

[52] U.S. Cl. ..... 239/291; 239/300; 239/405; 239/497; 239/296

[58] Field of Search ..... 239/494, 497, 290, 291, 239/296, 300, 301, 495, 496, 405, 406

[56] References Cited

U.S. PATENT DOCUMENTS

| | | | |
|---|---|---|---|
| 1,849,300 | 3/1932 | Jenkins | 237/301 |
| 2,050,368 | 8/1936 | Neely | 239/406 |
| 2,740,670 | 4/1956 | Harder | 239/297 |
| 2,895,685 | 7/1959 | Peeps | 239/494 |
| 3,092,332 | 6/1963 | Bickel et al. | 239/405 |
| 3,296,015 | 1/1967 | Juvinall et al. | 239/290 |
| 3,332,623 | 7/1967 | Gallant | 239/290 |
| 4,392,617 | 7/1983 | Bakos et al. | 239/290 |
| 4,531,675 | 7/1985 | Muck | 239/290 |
| 4,744,518 | 5/1988 | Toth | 239/297 |
| 4,761,299 | 8/1988 | Hufstetler et al. | 118/630 |

*Primary Examiner*—Andres Kashnikow

*Assistant Examiner*—Christopher G. Trainor

*Attorney, Agent, or Firm*—Brooks & Kushman

[57] ABSTRACT

A spray gun including a turbine mechanism for reducing the turbulence of fanning air to more effectively control the shaping of a conical spray pattern. A spiral flow of fanning air is created by the turbine mechanism. The amount of pressurized air flowing through the turbine mechanism is controlled by a valve mechanism to provide a greater or lesser amount of fanning air. The improved spray gun is particularly useful in paint spray systems wherein air having a flow rate in excess of 5 CFM and a delivery pressure of less than 15 psi over atmospheric is communicated to the spray head of the spray gun. In one embodiment, the turbine and valve mechanisms include first and second sets of circumferentially-spaced inclined vanes, respectively, which cooperate to create the spiral flow of air. The valve mechanism includes an annular valve member which supports the second set of vanes. The turbine mechanism includes a turbine member which supports the first set of vanes. The valve member is mounted for rotary movement on the turbine member to move between open and closed positions to thereby control the amount of pressurized air flowing through the turbine mechanism. The valve member is maintained in a predetermined, axially spaced position from the turbine member by a locking ring to prevent air leakage therebetween.

14 Claims, 3 Drawing Sheets

SPRAY GUN HAVING A FANNING AIR TURBINE MECHANISM

TECHNICAL FIELD

This invention relates to spray guns and, in particular to spray guns including spray heads with shaping air orifices to provide fanning air.

In conventional paint spray guns, a stream of paint under pressure is discharged from a relatively small orifice in a nozzle while air under pressure is discharged into the stream from an annular opening surrounding the nozzle to atomize the stream of paint into a spray of fine particles. The spray as it moves away from the gun defines a conical pattern whose apex is at the nozzle.

It is often desired to modify the circular cross-section of the normal conical spray pattern. This process is called fanning. This is typically accomplished by providing at the front end of the gun a spray head having a pair of diametrically opposed ports which direct air jets toward opposite sides of the spray pattern to flatten the sides of the conical spray pattern.

In many prior art paint spray guns, adjustment of the fanning of the air is made by rotatably adjusting the air cap. This adjustment exerts a valving action which establishes a maximum airflow when the diametrically opposed valve ports lie in either a vertical plane containing the nozzle access or a horizontal plane containing the nozzle access.

Numerous prior art patents disclose paint spray guns in which fanning is adjustably controlled independently of the rotative orientation of the air cap by a valve member which is received within a spray gun housing for movement between fully open and fully closed positions. A manual operable mechanism adjusts the position of the valve member in the housing. The atomizing and fanning air are discharged from a single chamber formed in the air cap forward of the valve member prior to discharge into atomizing and fanning ports. Examples of such prior art patents include U.S. Pat. Nos. 1,849,300, 2,740,670 and 4,744,518.

One problem with such prior art paint spray guns is that the air discharged from the fanning ports fail to uniformly flatten the sides of the conical spray pattern against which they are directed and, consequently, do not properly control the shape of the spray pattern. This is caused by turbulence of the fanning air and is especially troublesome in paint spray systems where the atomizing air has a flow rate in excess of 5 CFM at the spray head and a delivery pressure of less than 15 psi over atmospheric pressure at the spray head.

Another problem with such guns is that the atomizing air may not properly atomize the paint spray.

DISCLOSURE OF THE INVENTION

An object of the present invention is to provide a spray gun including turbine means for reducing the turbulence of the fanning air to more effectively control the shaping of a conical spray pattern wherein a spiral flow of fanning air is created by the turbine means.

Another object of the present invention is to provide a spray gun including turbine means for reducing the turbulence of fanning air wherein the fanning air is derived from pressurized air having a flow rate in excess of 5 CFM at a spray head of the gun and a delivery pressure of less than 15 psi over atmospheric pressure at the spray head.

In carrying out the above objects and other objects of the present invention, the spray gun includes a housing assembly and an annular spray head mounted at the forward end of the housing assembly. The spray head has a central air discharge orifice which extends coaxially therethrough and diametrically opposed shaping air orifices. A nozzle is mounted on the housing assembly coaxially of the air discharge orifice. The nozzle has a liquid discharge orifice at the forward end for discharging liquid under pressure in a forwardly directed stream coaxially of the air discharge orifice. A first passage in the housing assembly supplies liquid under pressure to the liquid discharge orifice. A chamber is provided in the housing assembly and a mechanism is provided for supplying air under pressure to the chamber. A second passage in the housing assembly communicates pressurized air from the chamber to the air discharge orifice to atomize the liquid discharged from the liquid discharge orifice into a spray. A third passage in the spray head communicates pressurized air from the chamber to the shaping orifices in the spray head to control fanning of the spray. A valve mechanism in the housing assembly is adjustably movable between open and closed positions from adjusting the flow of pressurized air from the chamber to the third passage. A manually operable mechanism adjustably positions the valve mechanism. A turbine mechanism is coaxial of the air discharge orifice and has a forward end and a rearward end. The turbine mechanism receives the pressurized air at its rearward end from the chamber and creates a spiral flow of air at its forward end in the open position of the valve mechanism. The spiral flow of air is communicated through the third passage and is discharged from the shaping air orifices to control fanning of the spray by minimizing turbulence therein.

Preferably, the turbine mechanism includes a plurality of circumferentially-spaced, inclined vanes to create the spiral flow of air.

Also, preferably, the chamber supplies pressurized air having a flow rate in excess of 5 CFM and a delivery pressure of less than 15 psi. over atmospheric pressure. In the absence of such a turbine mechanism, fanning air derived from such low pressure, high volume air tends to cause imbalance in the resulting spray pattern due to the turbulence of such air.

The advantages accruing to a paint spray gun constructed in accordance with the above are numerous. For example, because the fanning air is created in a spiral flow, more effective control of the spray pattern is provided since turbulence is greatly reduced in the fanning air. Also, the liquid is more fully atomized.

Other advantages of the present invention will be readily understood as the same becomes better understood by reference to the following detailed description when considered in connection with the accompanying drawings.

BEST MODE FOR CARRYING OUT THE INVENTION

Figure 1:
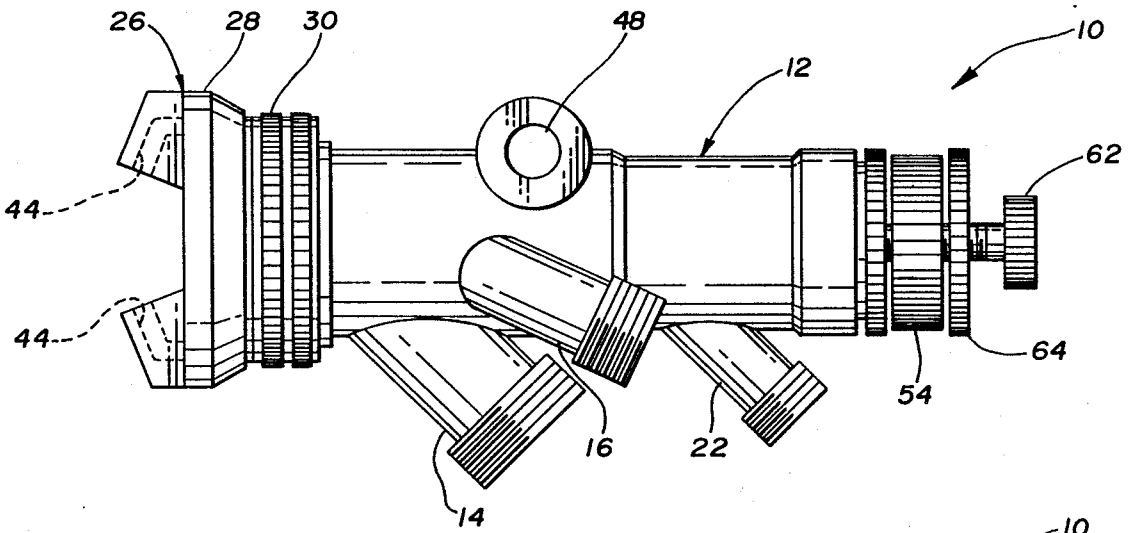
FIG. 1 is a side view of one embodiment of a paint spray gun constructed in accordance with the present invention.
Figure 2:
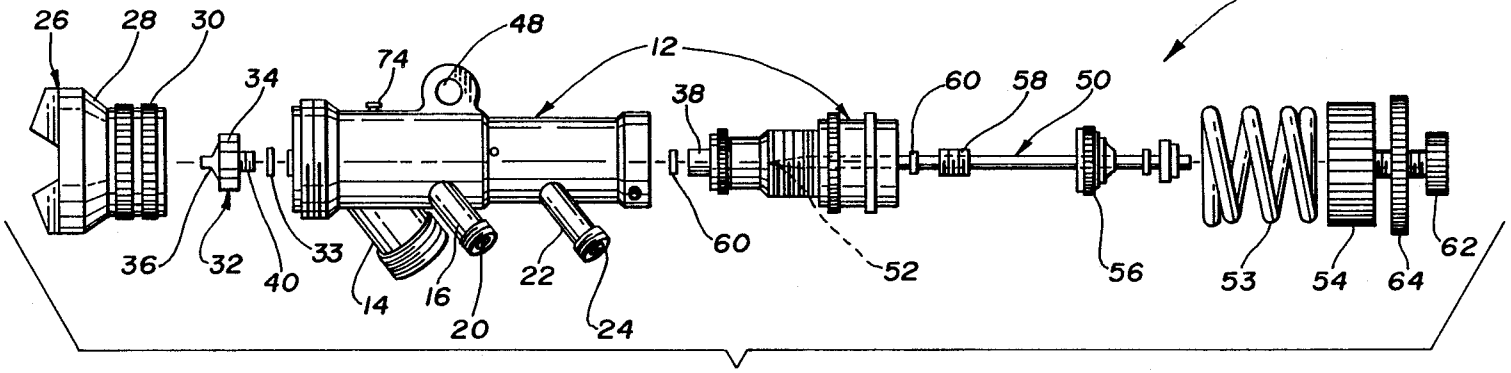
FIG. 2 is an exploded, slightly reduced view of the paint spray gun of FIG. 1.
Figure 8:
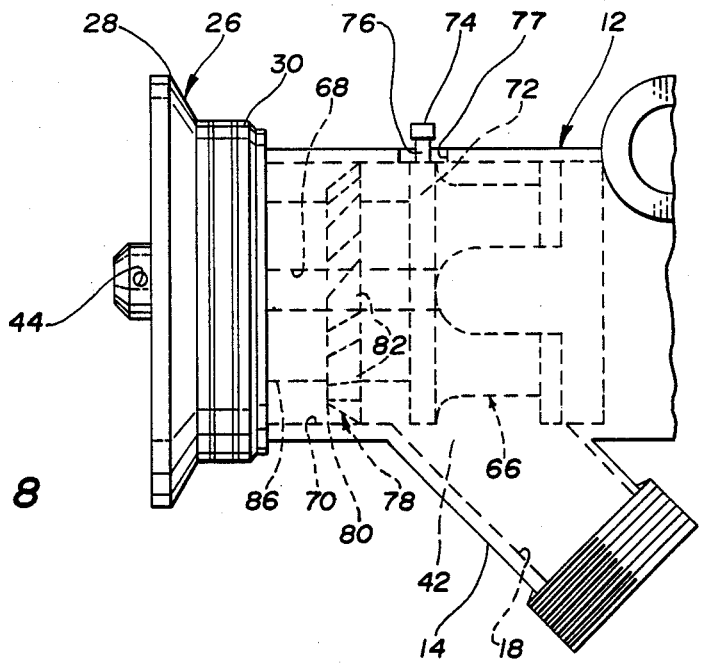
FIG. 8 is a view, partially broken away and enlarged illustrating valve and turbine mechanisms for use in the embodiment of FIGS. 1 and 2.

Referring to FIGS. 1, 2 and 8, there is illustrated a first embodiment of a spray gun constructed in accordance with the present invention, and generally indicated at 10. The gun 10 includes a housing assembly, generally indicated at 12, which has an atomizing air inlet tube 14 and a fluid inlet tube 16 which define input air and input liquid coating passages 18 and 20, respectively. The housing assembly 12 also has a control air inlet tube 22 which defines an inlet control air passage 24 for the supply of compressed air. The compressed air provides control signals for controlling the operating mode of the gun 10 in a conventional fashion.

The gun 10 also includes an air cap assembly, generally indicated at 26. The air cap assembly 26 includes a housing 28 and an internally threaded air cap fitting or nut 30 for securing the air cap assembly 26 to the rest of the gun 10.

The gun 10 further includes a nozzle or tip, generally indicated at 32, having radially projecting wings 34. The nozzle 32 has an internal, tapered bore or liquid discharge orifice (not shown, but similar to the orifice 35' in the second embodiment of FIG. 3) at its forward end 36 and is threadedly secured within an internally threaded spool or barrel 38 at its rearward end 40. the nozzle 32 is sealed by a tip gasket 33.

The input air passage 18 is in fluid communication with an annular air chamber 42 located about the barrel 38 within the housing assembly 12. In turn, the air chamber 42 is in fluid communication with a circular air discharge orifice (not shown but similar to the orifice 46' in the second embodiment of FIG. 3) and a pair of shaping orifices 44 formed in the housing 28 of the air cap assembly 26. The assembly 26 is threadedly connected to the rest of the gun 10 by the fitting 30 so that the liquid discharge orifice formed in the nozzle 32 is centrally disposed within the air discharge orifice. As is described in greater detail hereinbelow, parts of the second embodiment which have the same or similar functions to the parts of the first embodiment have the same reference numeral but have a prime designation.

The pair of diametrically opposing shaping air orifices 44 are directed towards the coating material sprayed from the nozzle to partially atomize the coating material and to shape the resulting pattern of atomized liquid coating material.

The liquid coating passage 20 is in fluid communication with a first passage or bore (not shown but similar to passage 47' in FIG. 3) formed in the barrel 38. In turn, the first passage communicates with the liquid discharge orifice.

The gun 10 further includes a mounting rod 48 for mounting the gun 10 to a spray fixture for automatic operation under control of the control signals from the control air passage 24. However, it is to be understood that the gun 10 may be modified for manual operation.

The flow of liquid coating material through the barrel 38 and the nozzle 32 is controlled by a control pin or valve, generally indicated at 50. The pin 50 has a tapered forward end portion 52 which selectively opens or closes the liquid discharge orifice in the nozzle 32 upon axial movement thereof. The pin 50 is normally held in its closed position by a spring 53 which extends between the housing assembly 12 and a spring stop 54. The pin 50 moves against the spring 53 towards its open position upon receiving control signals which act upon a piston member 56 concentrically mounted rearward on the pin 50.

A packing screw and washers 58 and 60, respectively, fluidly seal the pin 50 within the barrel 38. An adjustment screw 62 adjusts the position of the pin 50 within the barrel 38 and a check nut 64 secures the desired position.

Figure 9:
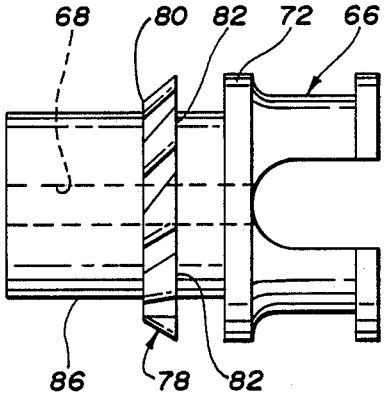
FIG. 9 is a side elevational view of the turbine and valve mechanisms of FIG. 8.
Figure 10:
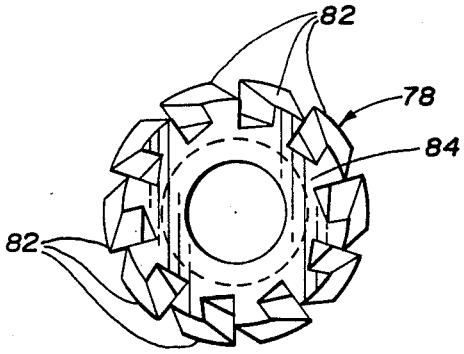
FIG. 10 is a front elevational view of the turbine mechanism of FIGS. 8 and 9.

Referring now to FIGS. 8 through 10, there is illustrated a valve means or mechanism, generally indicated at 66, which is axially movable between open and closed positions for adjusting the flow of air from the chamber 42 to second and third passages 68 and 70, respectively. The valve mechanism 66 includes an annular valve member 72 which is movable within the housing assembly 12 by a manually operable member 74 which is connected at one end of a pin 76. The opposite end of the pin 76 is threadedly secured to the valve member 72 to axially move the valve mechanism 66. The pin 76 extends through an elongated slot 77 in the housing assembly 72 which permits axial movement of the pin 76 relative to the housing assembly 12. Adjustment of the axial position of the valve member 72 within the housing assembly 12 controls the flow of air from the chamber 44 to the second and third passages 68 and 70, respectively.

A turbine means or mechanism, generally indicated at 78, is located in the third passage 70 coaxially of the air discharge orifice for creating a spiral flow of air at its forward end 80. The spiral flow of air is communicated to and discharged from the shaping orifices 44 to control fanning of the spray. The turbine mechanism 78 includes a plurality of circumferentially-spaced, inclined vanes 82 to create the spiral flow of air. The vanes 82 are supported on an annular turbine member 84 within which the valve member 72 is slidably mounted for axial movement within the turbine member 84.

The turbine member 84 includes an annular portion 86 which extends coaxially forwardly from the vanes 82. The annular portion 86 defines a portion of both the second and third passages 68 and 70, respectively.

Referring now to FIGS. 3 through 7, there is illustrated a second embodiment of a gun 10' constructed in accordance with the present invention. Parts of the second embodiment that perform the same or similar functions to the parts of the first embodiment have the same reference numeral, but are given a prime designation to distinguish the second embodiment from the first embodiment of the invention. Other than specifically noted, the description relating to the first embodiment is applicable with respect to the second embodiment.

Figure 3:
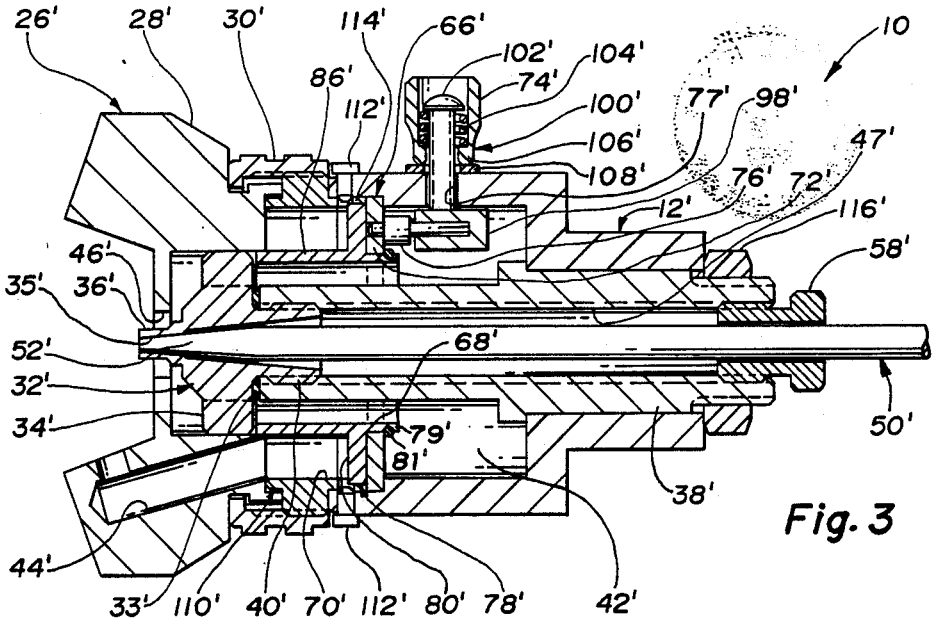
FIG. 3 is a view, partially broken away and in cross-section of a second embodiment of a spray gun of the present invention.
Figure 4:
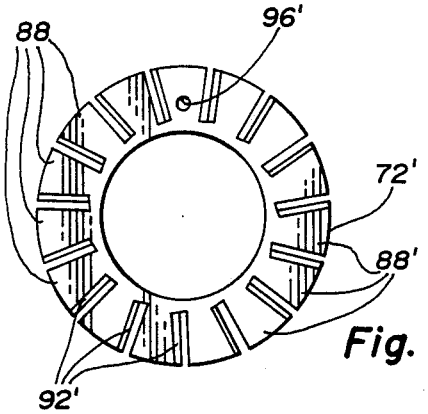
FIG. 4 is a rear elevational view of a movable collector fin of FIG. 3.
Figure 5:
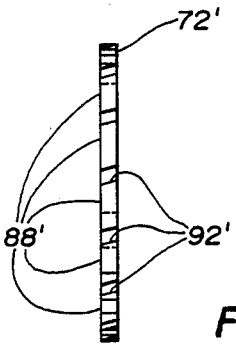
FIG. 5 is a side elevational view of the collector fin of FIG. 4.
Figure 6:
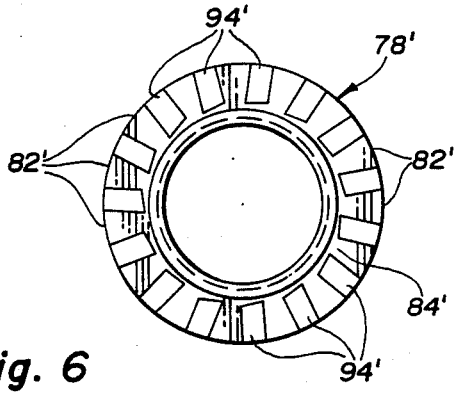
FIG. 6 is a rear elevational view of a stationary collector fin of FIG. 3.
Figure 7:
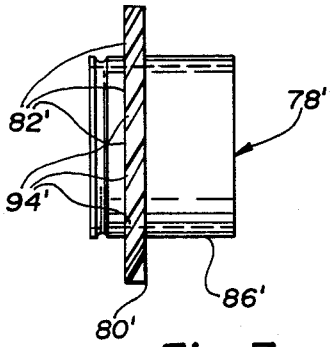
FIG. 7 is a side elevational view of the collector fin of FIG. 6.

Referring specifically to FIGS. 3 through 5, a valve member 72' of a valve mechanism, generally indicated at 66', supports a second set of circumferentially-spaced inclined vanes 88' which are axially spaced from a first set of vanes 82' supported by a turbine member 84'. The first and second sets of vanes 82' and 88', respectively, cooperate to cause a spiral flow of air in an open position of the valve member 72'. The vanes 88' supported by the valve member 72' block the flow of pressurized air from a chamber 18' in a fully closed position of the valve member 72'. In other words, when slanted openings or slots 92' between the vanes 84' are at least partially aligned with the equal number of slanted openings or slots 94', between the vanes 22', a spiral flow of air is created at a forward end 80' of the turbine mechanism 78'.

The annular valve member 72' is supported for rotary movement on a rearwardly extending annular portion 79' of the turbine member 84' within the housing assembly 12' between the open and closed positions which, in turn, correspond to the fully aligned and non-aligned positions, respectively, of the openings 92' with the openings 94'. A locking ring 81' on the portion 79' of the turbine member 84' maintains the axial position of the valve member 72' relative to the turbine member 84' to prevent air leakage therebetween.

An opening 96' is formed in the valve member 72' to receive and retain therein an adjustment pin 76'. In turn, the pin 76' is received and retained within an arcuate block 98' of a manually operable means or mechanism, generally indicated at 100'. The block 98' is curved at its outer surface to permit sliding movement thereof relative to the curved inner surface of the housing assembly 12'.

The mechanism 100' also includes a cap screw 102' which is threadedly secured at one end thereof to the block 98'. The cap screw 102' is biased away from the housing assembly 12' by a spring 104'. One end of the spring 104' engages the cap of the cap screw 102' and the other end of the spring 104' engages a shoulder portion 106' of an adjustment cap 74'. The shoulder portion 106' of the adjustment cap 74' engages a Teflon washer 108' which is disposed between the shoulder portion 106' and the housing assembly 12'.

The manually operable mechanism 100' adjustably positions the valve member 72' upon loosening the cap screw 102' to allow the cap screw 102' to move within a slot 77' elongated in a circumferential direction (not shown) upon exerting a manual, circumferential force at the adjustment cap 74'. In this way, the block 98', the pin 76' and the valve member 72' rotate within the housing assembly 12' and are thereby infinitely adjustable between a fully open and fully closed position of the valve member 72'. In other words, the valve member 72' may be positioned within the housing assembly 12' to permit a greater or lesser amount of air from the chamber 42' to flow through the openings 92' and through at least partially aligned openings 94'.

Preferably, 15 of the openings 92' are provided and are slanted approximately 20° from the horizontal. Also, preferably, 15 openings 94' are provided in the turbine mechanism 78' and are slanted approximately 60° from horizontal. When the openings 92' and the openings 94' are at least partially aligned, a spiral flow of air is created at the forward end 80' of the turbine mechanism 78'. The spiral flow of air is communicated through the third passage 70' and is discharged from the shaping air orifices 44' to control fanning of the spray by minimizing turbulence within the fanning spray. Also, such fanning air assists in the liquid atomization process. Such turbulence is particularly troublesome when the air flow rate at the air cap 26' is in excess of 5 CFM and has a delivery pressure of less than 15 psi over atmospheric pressure, as provided in U.S. Pat. No. 4,761,299 having the same Assignee as the present application.

The spray gun 10' further includes an externally threaded annular ring, generally indicated at 110', which cooperates with a cylindrical portion 86' of the turbine mechanism 78' to define the third passage 70'. The annular ring 110' is threadedly secured to an internally threaded annular fitting 30' to secure the air cap 36' thereto. In turn, the annular ring 110' is secured to the housing assembly 12' by self-tapping screws 112'.

The turbine mechanism 78' is secured within an inner end portion 114' of the ring 110' to ensure that the turbine mechanism 78' is properly aligned with the valve member 72' and the housing assembly 12' upon assembly thereof.

An internally threaded tube or spool 38' defines a first passage 47' and is secured within the housing assembly 12' by a locking nut 116'. In turn, a central control pin or valve 50' is supported within the first passage 47' by a packing nut 58' which permits axial movement of the pin 50' in the liquid discharge orifice 52' of the nozzle 32' and within the first passage 47' of the threaded spool 38'.

As can be readily appreciated by one of ordinary skill in the art, the second embodiment of the invention of FIG. 3 through 7 can be conveniently employed within a manually operable gun body, which may be either metallic or plastic in construction.

The spray guns 10 and 10' of the present invention provide numerous advantages. For example, the turbine mechanisms 78 and 78', respectively, create spiral flows of fanning air at their forward ends 80 and 80', respectively, to provide an effective mechanism to control fanning of the liquid atomized spray discharged from the nozzles 32 and 32', respectively. Also, the spray guns 10 and 10' provide air which effectively atomizes the liquid spray.

While the best modes for carrying out the invention have been described in detail, those familiar with the art to which this invention relates will recognize various alternative ways of practicing the invention as defined by the following claims.

What is claimed is:

1. In a spray gun including a housing assembly; an annular spray head mounted at the forward end of said housing assembly; said spray head having a central air discharge orifice extending coaxially therethrough and diametrically opposed shaping air orifices; a nozzle mounted on said housing assembly coaxially of said air discharge orifice; said nozzle having a liquid discharge orifice at its forward end for discharging liquid under pressure in a forwardly directed stream coaxially of said air discharge orifice; first passage mean in said housing assembly for supplying liquid under pressure to said liquid discharge orifice; chamber means in the housing assembly; means for communicating air under pressure to the chamber means; second passage means in said housing assembly for communicating pressurized ar from the chamber means to said air discharge orifice to atomize liquid discharged from said liquid discharge orifice into a spray; third passage means in said spray head for communicating pressurized air from the chamber means to said shaping air orifices in said spray head to control fanning of the spray; valve means in said housing assembly adjustably movable between open and closed positions for adjusting the flow of pressurized air from said chamber means to said third passage means; manually operable means for adjustably positioning said valve means; the improvement comprising: turbine means having a forward end and a rearward end, the turbine means being coaxially of said air discharge orifice for receiving the pressurized air from the chamber means at the rearward end and creating a spiral flow of air at its forward end in the open position of the valve means, the spiral flow of air being communicated through the third passage means and being discharged from the shaping air orifices to control fanning of the spray by minimizing turbulence therein.

2. The invention as claimed in claim 1 wherein said turbine means includes a first set of circumferentially-spaced, inclined vanes to create the spiral flow of air.

3. The invention as claimed in claim 2, wherein said turbine means includes an annular turbine member for supporting the first set of vanes and wherein said valve means includes an annular valve member slidably mounted for axial movement relative to said turbine member.

4. The invention as claimed in claim 2 wherein said valve means includes a second set of circumferentially-spaced, inclined vanes axially spaced from said first set of vanes, said first and second sets of vanes cooperating to create the spiral flow of air in the open position and blocking the flow of air from the chamber means in the closed position.

5. The invention as claimed in claim 4 wherein said valve means includes an annular valve member for supporting the second set of vanes and mounted for rotary movement within said housing assembly between the open and closed positions.

6. The invention as defined in claim 3 or claim 5 wherein said first passage means is defined by a hollow tubular member secured to and extending coaxially rearwardly from said nozzle, said turbine member coaxially surrounding said tubular member to at least partially define said second passage means.

7. The invention as defined in claim 3 or claim 5 wherein said manually operable means includes a pin extending through the housing assembly and coupled at one end thereof to said valve means to move the valve means relative to said housing assembly.

8. The invention as defined in claim 1 wherein said chamber means includes an annular chamber formed in the housing assembly and coaxially surrounding said tubular member rearward of the valve means.

9. The invention as defined in claim 5 wherein said turbine means includes an annular turbine member for supporting the first set of vanes.

10. The invention defined in claim 3 or claim 9 wherein said turbine member includes an annular portion extending coaxially forward from said vanes, said annular portion defining a portion of both the second and third passage means.

11. The invention defined in claim 9 further comprising means for maintaining the first and second sets of vanes in a predetermined axially spaced position.

12. The invention defined in claim 11 wherein said turbine member rotatably supports the valve member.

13. The invention defined in claim 12 wherein said means for maintaining includes a locking ring disposed about the turbine member to prevent axial movement and allow rotary movement of said second set of vanes about the turbine member.

14. In a spray gun including a housing assembly; an annular spray head mounted at the forward end of said housing assembly; said spray head having a central air discharge orifice extending coaxially therethrough and diametrically opposed shaping air orifices; a nozzle mounted on said housing assembly coaxially of said air discharge orifice; said nozzle having a liquid discharge orifice at its forward end for discharging liquid under pressure in a forwardly directed stream coaxially of said air discharge orifice; first passage means in said housing assembly for supplying liquid under pressure to said liquid discharge orifice; chamber means in the housing assembly; means for communicating pressurized air having a flow rate in excess of 5 CFM and a delivery pressure of less than 15 psi over atmospheric pressure to the chamber means; second passage means in said housing assembly for communicating air from the chamber means to said air discharge orifice to atomize liquid discharged from said liquid discharge orifice into a spray; third passage means in said spray head for communicating air from the chamber means to said shaping air orifices in said spray head to control fanning of the spray; valve means in said housing assembly adjustably movable between open and closed positions for adjusting the flow of pressurized air from said chamber means to said third passage means; manually operable means for adjustably positioning said valve means; the improvement comprising: turbine means having a forward end and a rearward end, the turbine means being coaxially of said air discharge orifice for receiving the pressurized air from the chamber means at the rearward end and creating a spiral flow of air at its forward end in the open position of the valve means, the spiral flow of air being communicated through the third passage means and being discharged from the shaping air orifices to control fanning of the spray by minimizing turbulence therein.

* * * * *